US005373977A

United States Patent [19]

Migliorini

[11] Patent Number: 5,373,977

[45] Date of Patent: Dec. 20, 1994

[54] METHOD FOR TRANSFERRING PANTYHOSE FROM A LINE CLOSER MACHINE TO A TOE-CLOSER MACHINE AND APPARATUS FOR THE IMPLEMENTATION THEREOF

[75] Inventor: Pier L. Migliorini, Arezzo, Italy

[73] Assignee: Solis, S.r.l., Fract. Tavarnuzze, Italy

[21] Appl. No.: 86,425

[22] Filed: Jun. 30, 1993

[30] Foreign Application Priority Data

Aug. 3, 1992 [IT] Italy ..... FI92A164

[51] Int. Cl.[5] ..... A47G 25/90; A41M 43/00; D05B 1/00

[52] U.S. Cl. ..... 223/112; 223/75; 223/39; 112/262.2

[58] Field of Search ..... 223/112, 75, 77, 76, 223/39; 112/262.2

[56] References Cited

U.S. PATENT DOCUMENTS

| | | | |
|---|---|---|---|
| 4,444,140 | 4/1984 | Moyer . | |
| 4,485,753 | 12/1984 | Silla | 112/262.2 |
| 4,550,868 | 11/1985 | Hodges et al. | 223/75 |
| 4,558,653 | 12/1985 | Horton et al. | 112/262.2 |
| 4,564,133 | 1/1986 | Gazzarrini | 223/75 |
| 4,598,817 | 7/1986 | Bell, Jr. | 112/262.2 |
| 4,643,340 | 2/1987 | Bailey | 223/75 |
| 4,881,477 | 11/1989 | Gazzarini | 223/112 |

*Primary Examiner*—Clifford D. Crowder

*Assistant Examiner*—Bibhu Mohanty

*Attorney, Agent, or Firm*—McGlew and Tuttle

[57] ABSTRACT

Apparatus for transferring a pantyhose article from a Line Close machine to a Toe-Closer machine. A tensioning structure is disposed below the banister of the Line-Closer machine to put in tension the legs of the pantyhose, which hang down from said banister. A retractile tube is connected to an aspirator. Structure is provided to withdraw the elastic hem of the bodice from the forms of the Line-Closer machine by a clamp. Spreading structure is provided to spread apart vertically the bodice of the pantyhose being withdrawn from said forms by two crooks able to be spread apart vertically and which are supported by a carriage horizontally reciprocating in synchronism and in alignment with the clamp. Structure is provided to pick up the bodice of the pantyhose from said crooks and fit it over the tubes of the Toe-Closer machine by turning it inside out using two parallel and spaced apart hooks driven into horizontal reciprocating motion and disposed parallel and on opposite side to said tubes. Structure is provided to spread open the thus stretched legs of the pantyhose and bring the tow of the feet thereof close to the mouth of the everter tubes of the Toe-Closer machine. A plate having a "W" shaped profile which is supported by vertical arm fixed to a carriage sliding onto a straight guide rail is provided having its axis (a) upwardly inclined.

4 Claims, 6 Drawing Sheets

METHOD FOR TRANSFERRING PANTYHOSE FROM A LINE CLOSER MACHINE TO A TOE-CLOSER MACHINE AND APPARATUS FOR THE IMPLEMENTATION THEREOF

FIELD OF THE INVENTION

The present invention refers to a method for transferring pantyhose from a Line closer machine to a Toe-closer machine and an apparatus for the implementation thereof.

BACKGROUND OF THE INVENTION

It is known to those skilled in the art that at the exit of a machine performing the closing seam of two stockings to make a pantyhose article, the legs of the article tend to overlap each other in a braid or twist-like fashion, and that they need to be separated to allow the transfer of the pantyhose article into further operating locations such as the one where a machine can carry out the sewing of the toe of the feet.

The U.S. Pat. No. 4,444,140 discloses a transfer device for automatically transferring the hosiery blanks from a Line-Closer to a Toe Closer which includes an L-shaped member having a horizontal arm with a pair of U-shaped spaced brackets to laterally space the leg portions of fabric during the transfer and a pair of hooks to remove the panty from the corresponding hosiery forms of the Line Closer, and turn it for 90° for its reversed loading on the suction tubes of the Toe Closer.

But this known device requires that the Line Closer is equipped with several pairs of U-shaped brackets similar in size, shape and spacing to brackets of the said horizontal arm of transfer device.

Furthermore, it's required that in the operation an operator loads each item in turn in the Line Closer and them laterally separates the freely downwardly hanging foot and leg portions of each pair of hosiery blanks.

Also, the transferring of the hosiery from the Line Closer to the Toe Closer includes a step wherein the leg and foot portions of the hosiery are transferred to and are retained in the Toe Closer and the panty portion is retained in the Line Closer.

However, the time necessary for non-specialized operators to carry out this operation is too long with respect to the time of sewing the stockings together, which takes a few seconds; accordingly, there is a need for specially trained personnel to perform the laying of the stockings onto said supports as fast and over long periods of time as required, but nonetheless, the production potentiality of the Toe-Closer machine cannot be exploited in full as it is limited by the speed of this manual operation. Such limitation and the high cost of specialized labor, contribute to raise the cost of making the pantyhose.

SUMMARY AND OBJECTS OF THE INVENTION

It is the main object of the present invention to overcome the above mentioned drawbacks and to provide a method and an apparatus for the automatic transfer of pantyhose articles from a Line closer machine to a Toe-closer machine. This result has been achieved, according to the invention, by adopting an operating method which comprises:

holding the pantyhose by the elastic hem of the bodice being stretched over the horizontal forms of the Line closer machine, with the two bodice seams resulting in a vertical plane intermediate to the forms, and with the legs of the pantyhose hanging down beyond the machine banister;

stretching downwards the so the pendent legs of the pantyhose by a flow of sucked air;

withdrawing the elastic hem of the pantyhose bodice from the forms of the Line close machine and spreading it open vertically to allow the subsequent hold by the relevant hooks;

spreading apart the so stretched legs and transferring them up to the mouth of the pneumatic everter tubes of a Toe-Closer machine, and simultaneously moving forward the hooks which retain the bodice.

And in order to carry out said method an apparatus is used comprising:

means to stretch the pantyhose legs, with an air aspirator disposed below the banister of the Line closer machine, in correspondence with the loading station;

means to withdraw the elastic hem of the pantyhose from the forms of the Line closer machine, by means of a clamp mounted on a carriage reciprocating horizontally and disposed above said banister;

means to spread apart vertically the elastic hem of the bodice, by means of two crooks able to spread apart vertically and move forward horizontally;

means to pick up the pantyhose bodice from said crooks and fit it over the tubes of the Toe-closer machine by turning the bodice inside out, by means of two parallel and spaced apart hooks which are driven into a horizontal reciprocating motion and are disposed in alignment with said everter tubes;

means to spread apart the stretched legs of the pantyhose and bring the toe thereof close to the mouth of the everter tubes of the Toe-closer machine, by means of a plate having "W" shape profile supported by a carriage movable along a straight and upwardly inclined trajectory.

The advantages achieved through the present invention lie essentially in that it is possible to operate automatically and very rapidly the transfer of the pantyhose articles from a Line closer machine to a Toe-closer machine; that it is possible the reduce the overall production cost; that the proposed apparatus is easy to build, of limited cost and high reliability also after a prolonged period of service; and that is easily applicable to any known type of Line closer machine.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
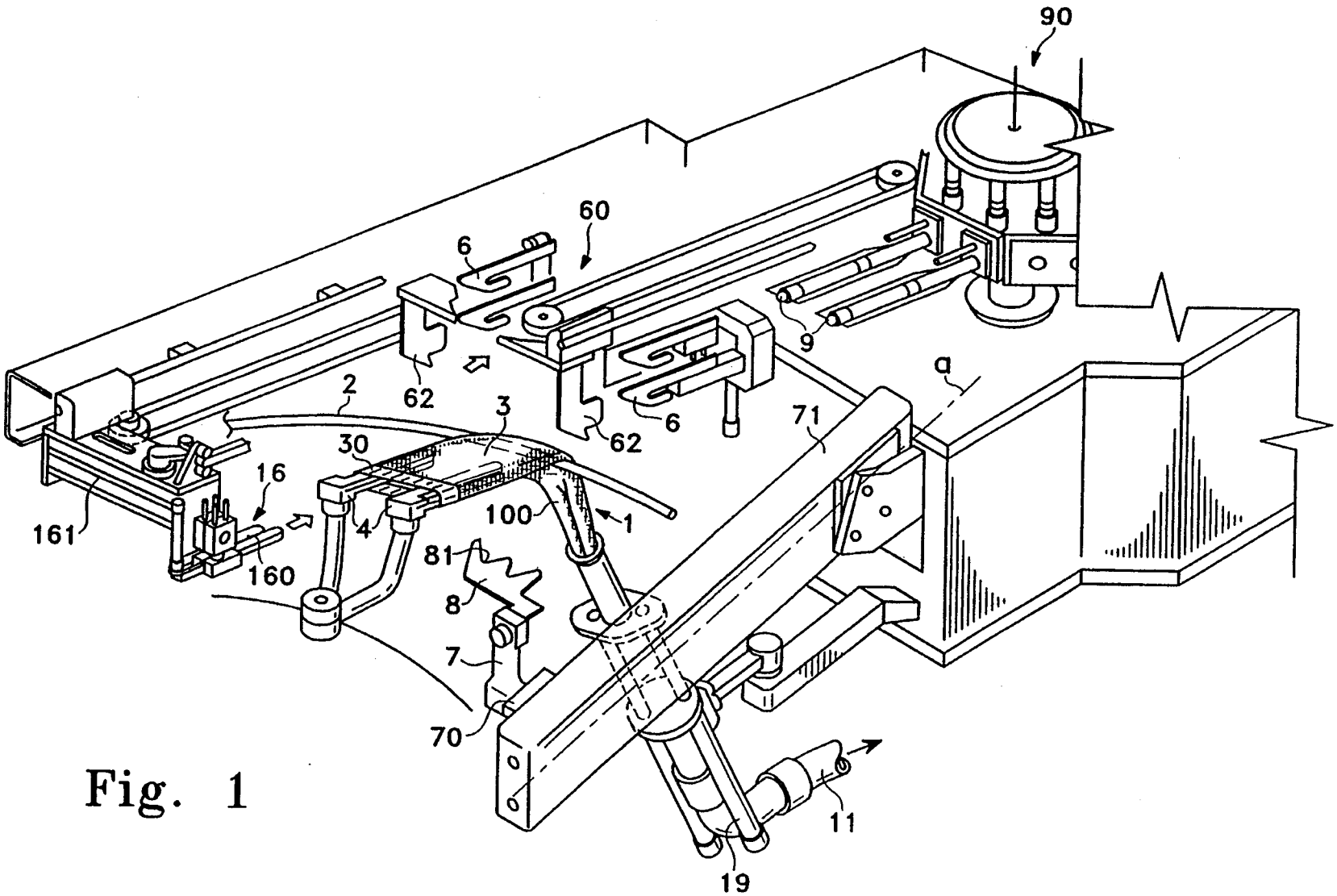
FIG. 1 shows the perspective, partly sectioned view of an apparatus according to the invention during the step of stretching the pantyhose legs prior to its discharge from the Line closer machine.
Figure 2:
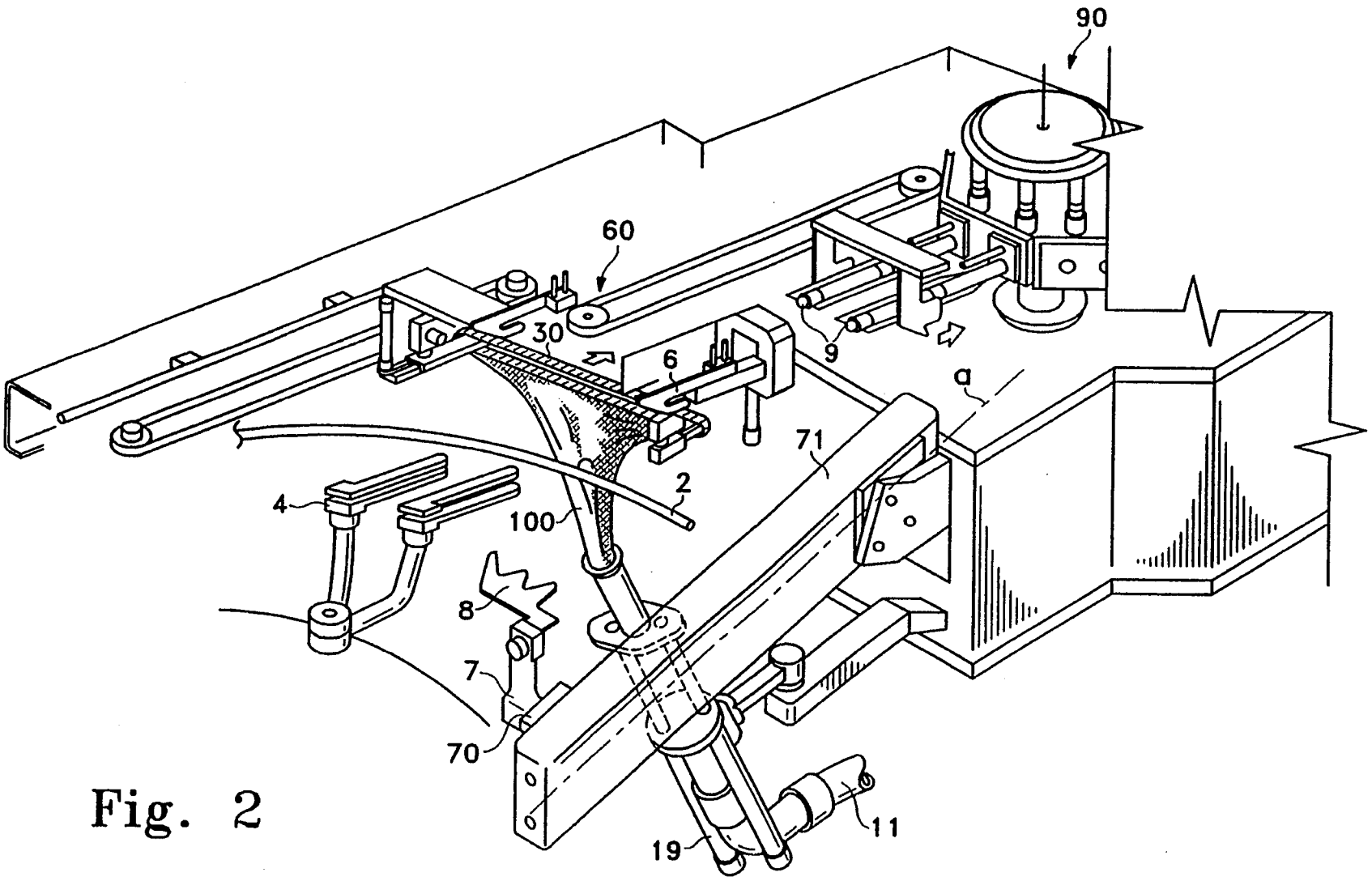
FIG. 2 shows the perspective, partly sectioned view of the apparatus of FIG. 1, during the step of discharging the pantyhose from the Line closer machine.
Figure 3:
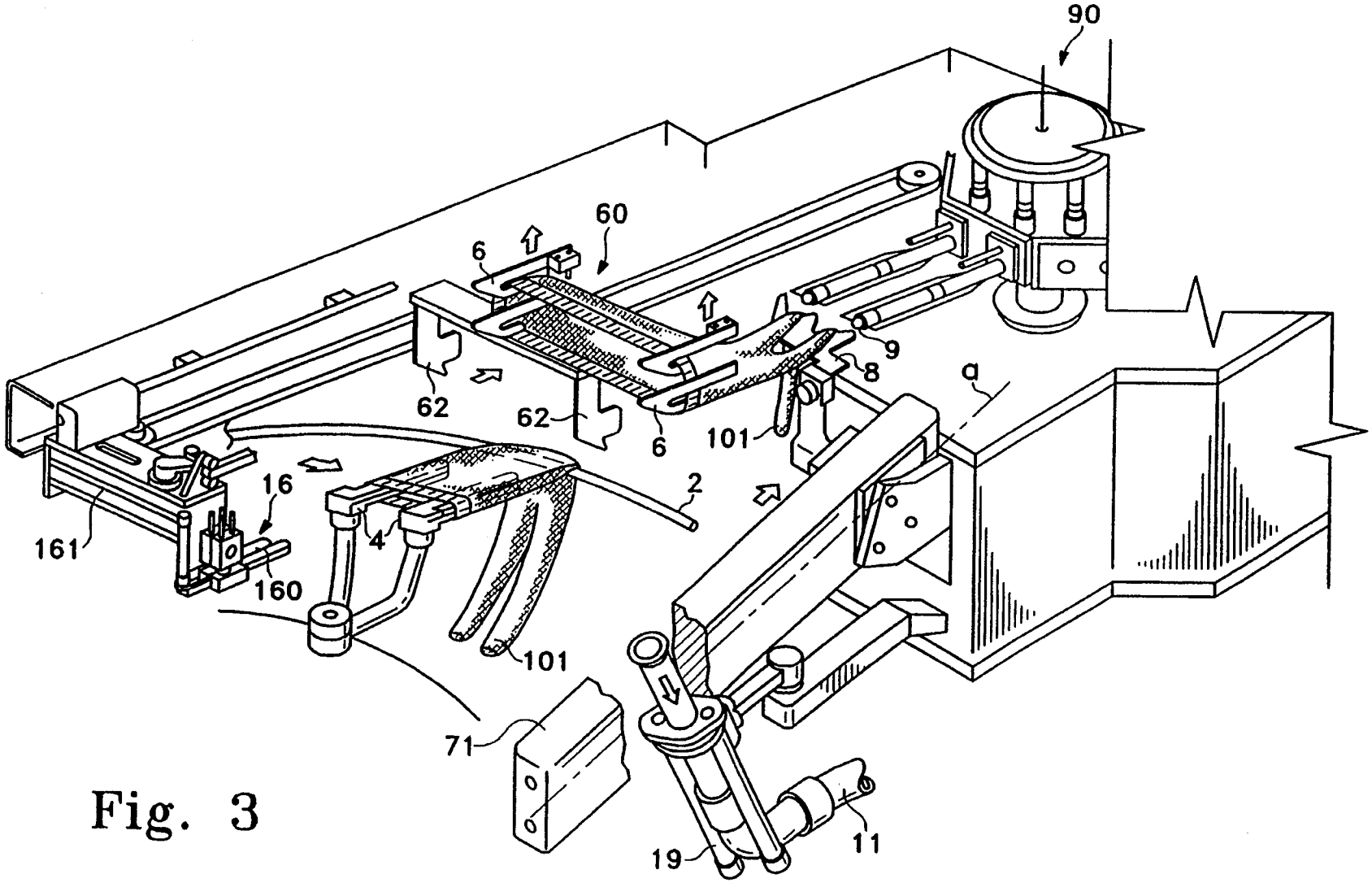
FIG. 3 shows the perspective view of the apparatus of FIG. 1 during the step of transferring the pantyhose to the Toe-closer machine.
Figure 4:
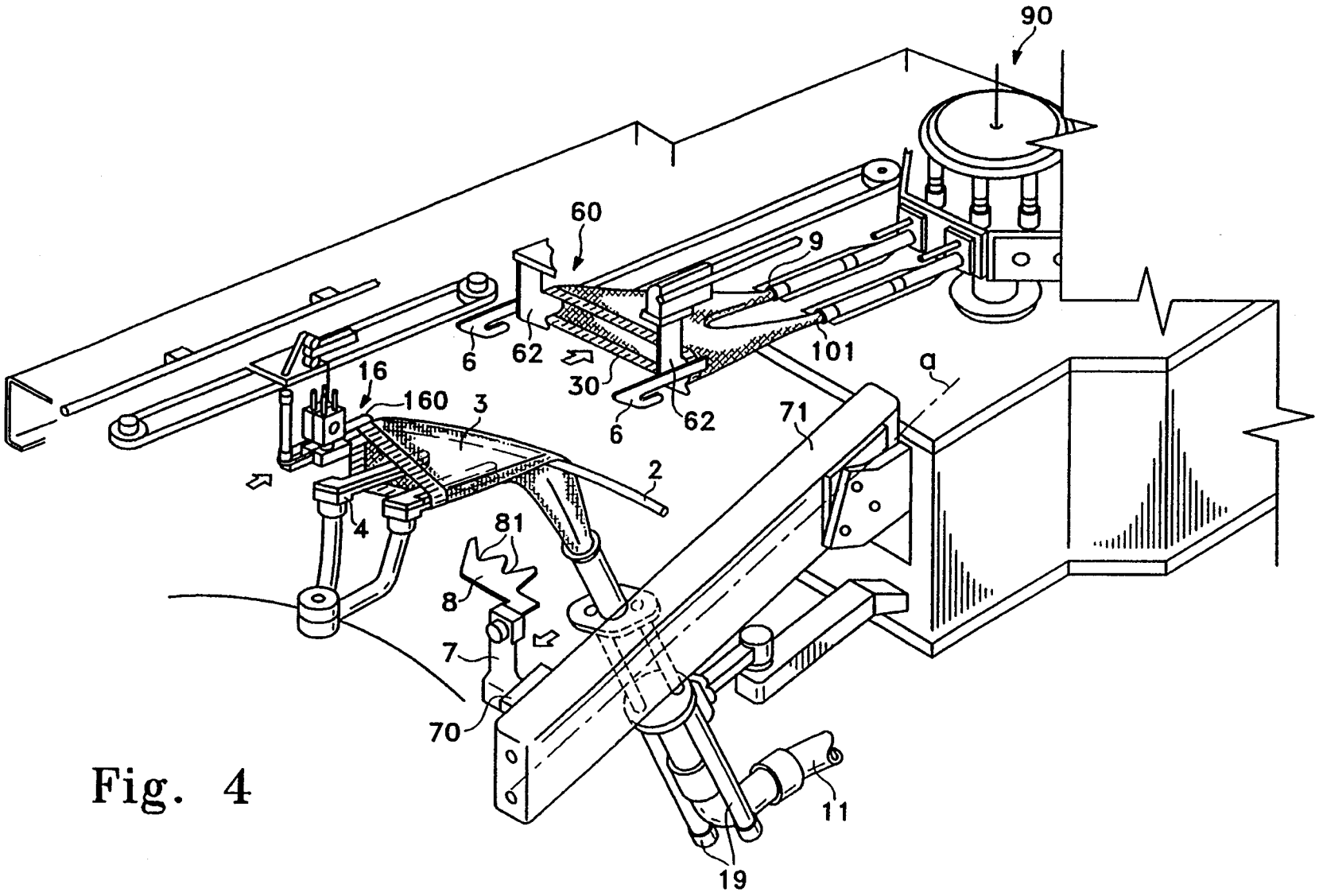
FIG. 4 shows the perspective view of the apparatus of FIG. 1 during the step of sucking the spread apart legs of the pantyhose into the everter tubes of the Toe-closer machine.
Figure 5:
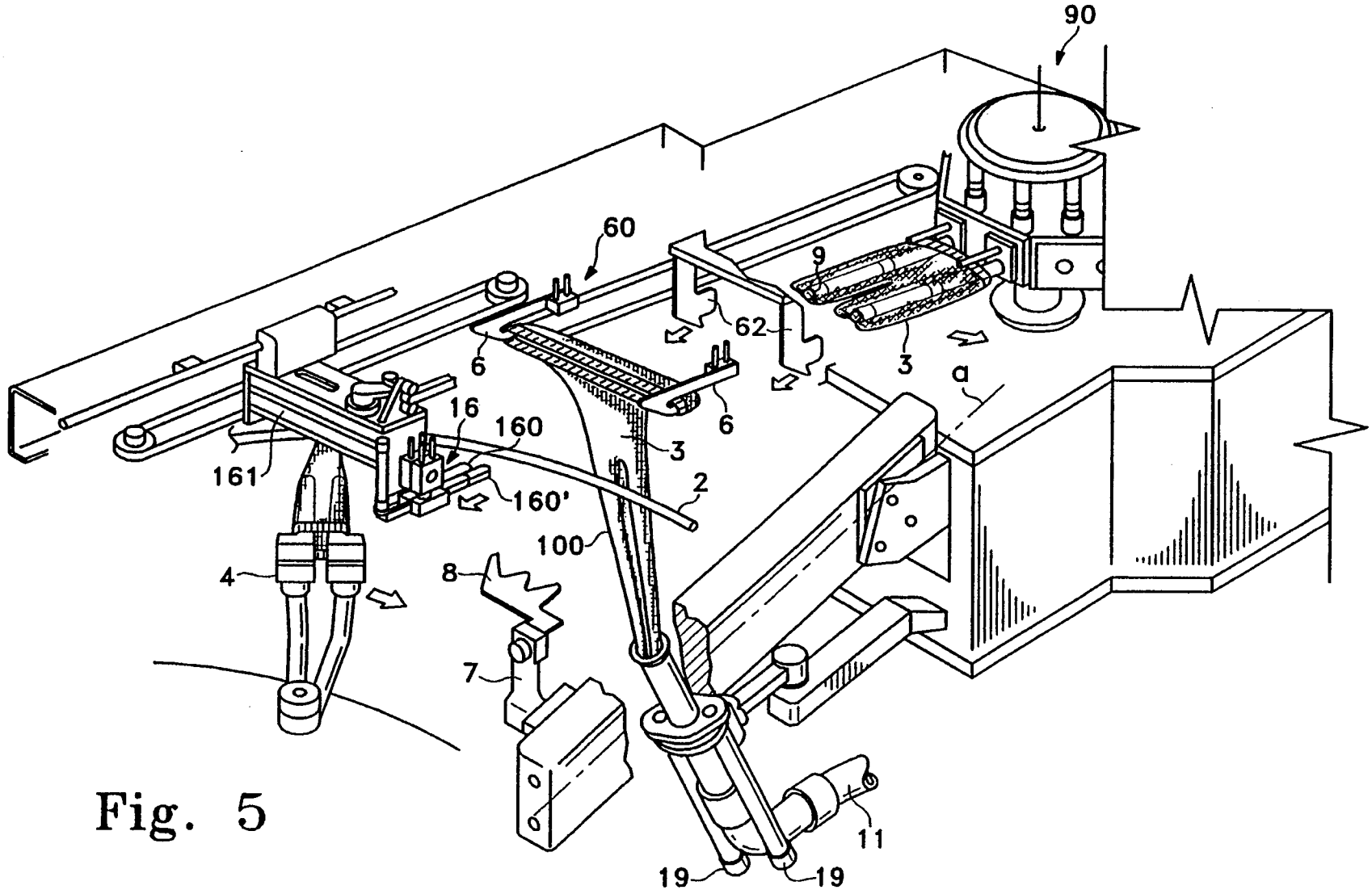
FIG. 5 shows the perspective view of the apparatus of FIG. 1 upon completion of the step of reversing the pantyhose over the tubes of the Toe-closer machine.
Figure 6:
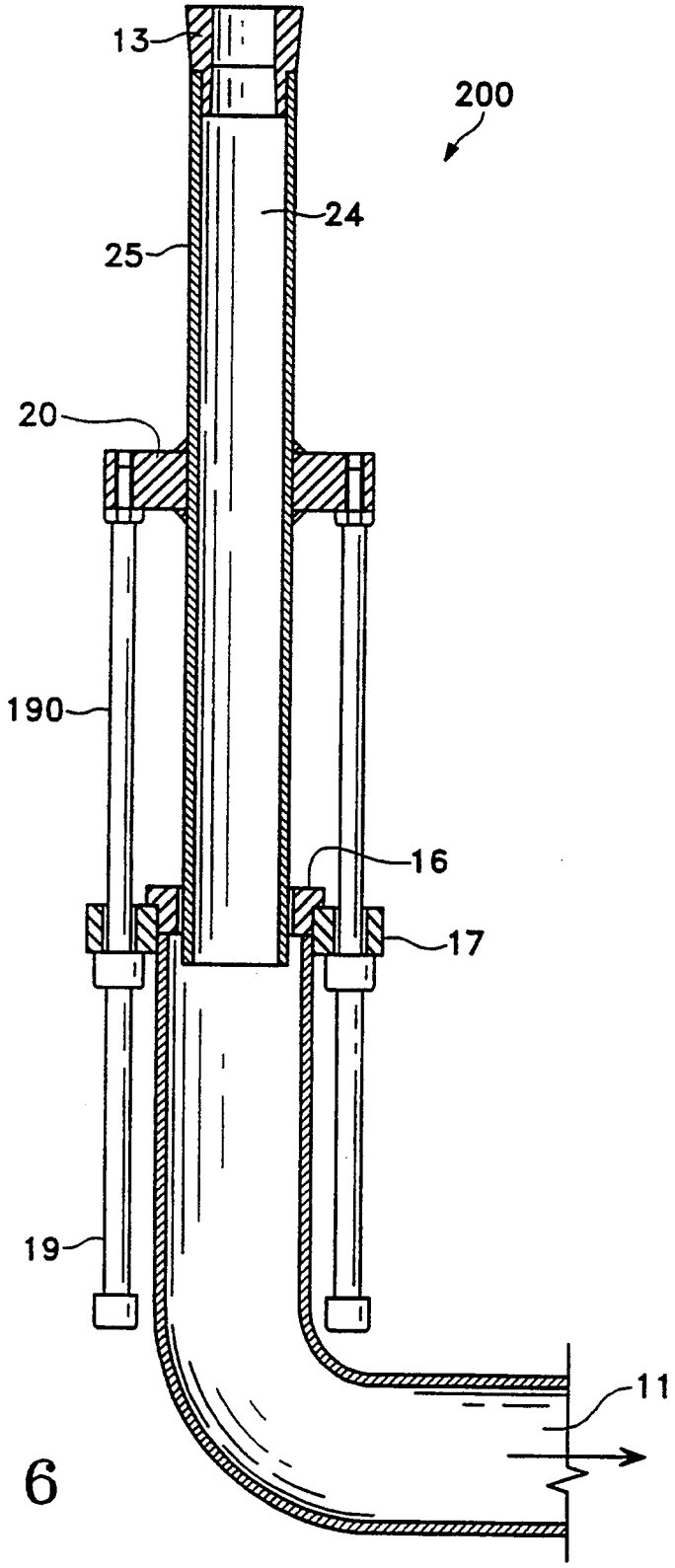
FIG. 6 shows the longitudinal section view of the detail of the aspirator of FIG. 1 in operative attitude.

Reduced to its basic structure, reference being made to the attached drawings, the method of transferring a pantyhose article from a Line closer machine to a Toe-closer machine, according to the invention, includes in sequence the following operating steps:

retaining the pantyhose (1) by the elastic hem (30) of the bodice (3) being stretched over the horizontal forms (4) of the Line closer machine, with the two seams of the bodice (3) lying in a vertical plane intermediate to the forms (4), and with the legs (100) hanging down beyond the machine banister (2);

stretching downwards the thus hanging legs (100) of the pantyhose by means of a flow of sucked air producing a slight stretch which causes the entangled legs (100) to become straight;

picking up, that is, horizontally withdrawing the elastic hem (30) of the bodice (3) from the forms of the Line closer machine and spreading it open vertically to allow the subsequent grip;

spreading apart the thus stretched legs (100) of the pantyhose (1) and simultaneously transferring them, together with the bodice (3), up to the mouth of the two everter tubes (9) of a Toe-closer machine (90) and simultaneously move forward the hooks which retain the bodice.

As far as the means for implementing said method are concerned, they include:

means (200) disposed below the banister (2) of the Line closer machine to put in tension, that is, to stretch downwards the legs (100) of the pantyhose (1) which hang down from said banister (2) and comprising a tube (25) provided with a flange (20) secured on top of stems or connection rods (190) going through the bottom of a fixed support (17) of two operating cylinders (19) disposed parallel and opposite to said tube (25) which can slide within a bush (16) fixed laterally to said support (17) and below to a second tube (11) which is coaxial to and of larger diameter than the first (25) and connected, at the other end, to an aspirator (not shown for safe of clarity in the attached drawings) so as to allow sucked air into the chamber (24) of the tube (25); the head of said tube (25) is fixed a guide bush (13) to facilitate the introduction of the legs (100) into said chamber (24);

means to withdraw the elastic hem (30) of the bodice (3) from the forms (4) of the Line closer machine by means of a clamp (16) having flat and horizontal projections (160,160') to allow an easy introduction thereof inside the elastic hem (3) of the bodice (3), one of which (160) being stationary, and the other (160') horizontally movable to move away from the first to allow the elastic hem (30) to be stretched after its introduction therein; said clamp (16) being fixed to a relevant horizontally reciprocating carriage (161) disposed above said banister (2);

means to spread apart vertically the bodice (3) of the pantyhose (1) being withdrawn from said forms (14) by means of two crooks (6) able to be spread apart vertically, which are supported by a carriage (60) horizontally reciprocating in synchronism and in alignment with said carriage (161);

means to pick up the bodice (3) of the pantyhose (1) from said crooks (6) and fit it over the tubes (9) of the Toe-closer machine (90) by turning it inside out by means of two parallel and spaced apart hooks (62) driven into horizontal reciprocating motion and disposed coplanar, in alignment with and externally parallel to said tubes (9);

means to spread open the thus stretched legs (100) of the pantyhose (1) and bring the toe of the feet (102) thereof close to the mouth of the everter tubes (9) of the Toe-closer machine (90), and comprising: a plate (8) having "W" shaped profile, that is, being provided with two recesses (81) and three tips turned toward the Toe-closer machine, which plate is supported by a vertical arm (7) fixed to a carriage (70) sliding onto a straight guide rail (71) having its axis (a) upwardly inclined to allow the ends of the legs to be raised at the level of the everter tubes (9) of the Toe-closer machine.

Advantageously, said plate (8) is able to rotate about a horizontal axis of said arm (7) through a rack and a relevant motor means (not shown for clarity in the drawing) to take up, during the active forward travel of carriage (70), a horizontal attitude and, during the idle return travel, a vertical, that is, 90° anti-clockwise turned attitude.

According to an alternative embodiment of the invention, the tube (25) of said suction means (200) is fixed, that is, unable to be withdrawn.

The operation of the apparatus is as follows.

When a pantyhose article (1) is at the discharge station ready to be unloaded from the Line closer machine, the underlying tube (25) is disposed in the extracted or lifted position and the suction of the air is operated to allow the legs (100) of the pantyhose (1) to be drawn into the chamber (24) and thus be slightly stretched therein. Once the suction of the air is turned off, the tube (25) is withdrawn thereby leaving the thus stretched legs (100) of the pantyhose (10) exposed, and the bodice (30) is grasped by the clamp (16) which, afterwards, moves past the crooks (6) and stops. At this point, the mobile projection (160') of the clamp (16) causes the hem (30) of the bodice (3) to stretch out horizontally, so that the crooks (6) can hook it and spread it open vertically. After the hem (30) has been spread open, the hooks (62) grasp the bodice (3) to fit it over the tubes (9) of the Toe-closer machine (90) by turning same bodice inside out and, afterwards, the carriage (161) moves back along with the clamp (16). At the same time, the carriage (70), with the plate (8) disposed horizontally and backwards of the pantyhose (1) so that each leg (100) of the pantyhose (1) will seat in a corresponding recess (81) of same plate (8), is caused to advance, and the forward travel of the carriage (70) causes the advancement and the lifting of the legs (100) so that, at the end of the travel, the terminal parts (101) of the pantyhose (1) will result in front of the mouth of the everter tubes (9) of the Toe-closer machine to be sucked therein. Afterwards, the plate (8) is rotated 90° anti-clockwise and brought back by the carriage (7) to its initial position wherein, through a 90° clockwise rotation, is made to resume its horizontal operative position. Afterwards, the tube (25) is withdrawn once again to work the next pantyhose which is at the discharge station of the Toe-closer machine.

Practically, all the construction details may vary in any equivalent way as far as the form, dimensions, elements disposition, nature of the used materials are concerned, without nevertheless departing from the scope of the adopted solution idea and, thereby, remaining within the limits of the protection granted to the present patent for industrial invention.

I claim:

1. Method of transferring a pantyhose article from a Line-Closer machine to a Toe-Closer machine, comprising the steps of:

retaining the pantyhose by the elastic hem of a bodice of the pantyhose being stretched over horizontal forms of the Line-Closer machine, with two seams of the bodice lying in a vertical plane intermediate to the horizontal forms, and with legs hanging down beyond a machine banister;

stretching downwards the thus hanging legs of the pantyhose by means of a flow of sucked air for producing a slight stretch which causes the entangled legs to become straight;

picking up and horizontally withdrawing the elastic hem of the bodice from the forms of the Line-Closer machine and spreading it open vertically to allow a subsequent gripping;

spreading apart the thus stretched legs of the pantyhose and simultaneously transferring them, together with the bodice, up to the mouth of two everter tubes of the Toe-Closer machine.

2. Apparatus for transferring a pantyhose article from a Line-Closer machine to a Toe-Closer machine comprising:

a machine banister forming part of said Line-Closer machine;

tension means disposed below the machine banister of the Line-Closer machine to put in tension and to stretch downwards, legs of the pantyhose which hang down frown said machine banister, said tension means including a first tube provided with a flange, connection rods connected to said flange and extending downwardly through a bottom of a fixed support of two operating cylinders disposed parallel and opposite to said first tube, said operating cylinders being mounted to slide within a bushing fixed laterally to said fixed support and connected to a first end of a second tube, said second tube being coaxial to and of a larger diameter than said first tube, and being connected, at a second end of the second tube, to an aspirator so as to allow the suction of air into a chamber of said first tube, and a guide bush, to facilitate the introduction of the legs into said chamber of said first tube, connected to a head of said first tube;

withdrawing means to withdraw an elastic hem of a bodice of the pantyhose from forms of the Line-Closer machine, including a clamp having flat and horizontal projections to allow an easy introduction thereof inside the elastic hem of the bodice, one of said projections being a stationary projection, and another of said projections being horizontally movable to move away from said stationary projection to allow the elastic hem to be stretched, said clamp being fixed to a horizontally reciprocating carriage disposed above said banister machine;

bodice spreading means to spread apart vertically the bodice of the pantyhose being withdrawn from said forms including two crooks able to be spread apart vertically, said crooks being supported by another carriage, horizontally reciprocating in synchronism and in alignment with said horizontally reciprocating carriage;

pick up means to pick up the bodice of the pantyhose form said crooks and fit the bodice of the pantyhose over tubes of the Toe-Closer machine by turning the pantyhose inside out by means of two parallel and spaced apart hooks driven into horizontal reciprocating motion and disposed parallel and on a side opposite said tubes of the Toe-Closer machine;

leg spreading means to spread open the thus stretched legs of the pantyhose and bring the toe of the feet of the pantyhose close to the mouth of the everter tubes of the tow-closer machine; and a plate having a "W" shaped profile and provided with two recesses and three tips turned toward the Toe-Closer machine, said plate being supported by a vertical arm fixed to a carriage sliding onto a straight guide rail, said guide rail having an axis upwardly inclined to allow the ends of the legs to be raised at the level of the everter tubes of the Toe-Closer machine.

3. Apparatus according to claim 2, wherein said plate is rotatable about a horizontal axis of said vertical arm by means of a rack and motor to take up, during the active forward travel of the carriage, a horizontal attitude and, during the idle return travel, a vertical attitude.

4. Apparatus according to claim 2, characterized in that said first tube of the aspirator unit is stationary.

* * * * *